United States Patent [19]

von Ingelheim

[11] Patent Number: 4,843,814

[45] Date of Patent: Jul. 4, 1989

[54] ASSEMBLY FOR PRODUCING A PROPULSIVE FORCE

[76] Inventor: Peter G. von Ingelheim, Sillertshausen 35, D-8309 Au i.d. Hallertau, Fed. Rep. of Germany

[21] Appl. No.: 93,526

[22] PCT Filed: Dec. 1, 1986

[86] PCT No.: PCT/DE86/00488

§ 371 Date: Jul. 31, 1987

§ 102(e) Date: Jul. 31, 1987

[87] PCT Pub. No.: WO87/03264

PCT Pub. Date: Jun. 4, 1987

[30] Foreign Application Priority Data

Dec. 2, 1985 [DE] Fed. Rep. of Germany ..... 3542541

[51] Int. Cl.[4] ..... F02K 11/00; B63H 11/10

[52] U.S. Cl. ..... 60/200.1; 60/221; 440/38

[58] Field of Search ..... 60/39.43, 200.1, 269, 60/271, 221, 222, 247, 249; 415/77, 79; 440/38, 40

[56] References Cited

U.S. PATENT DOCUMENTS

| | | | |
|---|---|---|---|
| 2,398,113 | 4/1946 | Parrish | 415/79 |
| 3,041,831 | 7/1962 | Singleman | 60/221 |
| 3,095,696 | 7/1963 | Rumble | 415/79 |
| 3,247,667 | 4/1966 | Adams et al. | 60/222 |
| 3,276,415 | 10/1966 | Laing | 440/40 |
| 3,354,650 | 11/1967 | Malroux | 60/249 |
| 3,462,955 | 8/1969 | Lockwood et al. | 60/249 |
| 3,756,019 | 9/1973 | Holzapfel et al. | 60/39.43 |
| 3,835,643 | 9/1974 | DeGarcia et al. | 60/39.43 |
| 4,672,807 | 6/1987 | Gongwer | 440/38 |

FOREIGN PATENT DOCUMENTS

| | | | |
|---|---|---|---|
| 459186 | 7/1945 | Belgium . | |
| 1274268 | 11/1960 | France | 60/39.43 |
| 274217 | 3/1930 | Italy | 440/38 |

*Primary Examiner*—Louis J. Casaregola

*Attorney, Agent, or Firm*—Foley & Lardner, Schwartz, Jeffery, Schwaab, Mack, Blumenthal & Evans

[57] ABSTRACT

A body surrounded by a fluid is moved in a predetermined direction by a driving unit (1) which produces a negative pressure, whereby the fluid is sucked from the environment, the velocity of the flowing fluid relative to the body is increased by energy supply and the fluid is ejected at said increased velocity in opposition to the direction of movement. The fluid is sucked through an arcuate channel (5, 6) which is fixed on the body and which changes the direction of flow of the fluid such that the directional vector of the sucked fluid flowing into the channel (5, 6) and the vector in the direction of movement of the body form an angle which differs from 180° and at low speeds preferably are disposed in the same direction.

3 Claims, 4 Drawing Sheets

ASSEMBLY FOR PRODUCING A PROPULSIVE FORCE

FIELD OF THE INVENTION

The invention is directed to an assembly for producing a propulsive force by variation of the impulse of inflowing and outflowing fluids.

BACKGROUND AND DESCRIPTION OF PRIOR ART

Engine systems of this type are known for use as propellers or jet engines in aircraft and ships. With propellers or jet engines, a fluid having the mass m is sucked in at the velocity w in opposition to the desired direction of movement of the body to be propelled, the relative velocity of flow of the fluid through the propeller or the jet engine is increased to the velocity c, and the fluid is ejected at the relative velocity c (relative to the propeller or jet engine) in opposition to the direction of movement of the body. That is, the impulse of the fluid flowing through the body is varied within the body as to its magnitude. Thus, a stabilizing force acts on the body and as a reactive force is directed against the force variation at the fluid and therefore acts in the direction of movement of the body. The force magnitude in the direction of movement is $I=m(c-w)$. For rockets, the force is generated by ejection at the velocity c of a medium that is carried along. The force magnitude therefore is $I=m \cdot c$.

In drive systems of this type the level of the maximum impulse at low velocities is hardly above the force at higher velocities. For propellers and jet engines, the increase of the body velocity v is accompanied by an increase of the inflow velocity w. Thereby the specific force per kg of medium throughput is decreased. But with increasing velocity v, the dynamic pressure forward of the engine and thus the outflow velocity c will also increase, and the throughput of the mass m will also increase, so that on the whole the thrust remains more or less constant. For rockets, the constancy of the propulsive force can be taken direct from the formula.

The effect of transmissions is known in relation to vehicle drive systems. By means of the transmissions it is possible at low speeds to increase the maximum output torque at the wheels, whereby the propulsive force and the accelerating ability are improved while the amount of energy consumed is reduced.

It is the object of the invention to permit an increase in the propulsive force at low speeds also for drive systems of the kind which operate with a force variation of a sucked-in and ejected fluid.

SUMMARY OF THE INVENTION

The solution of the specified object is characterized in that, the fluid which is accelerated and sucked in by the induced negative pressure is subjected to a change in the direction of flow in a channel which is fixedly provided on the driven body. Due to the change of direction the fluid flowing through the channel produces a force against the channel walls. This force is oriented such that, in addition to the force generated by the ejected fluid, it acts in the direction of movement. Thereby the force mw resulting from the fluid which flows in against the direction of movement of the body is prevented, on the one hand, and the force directed against the channel wall is added to the "reactive thrust" of the ejected fluid, on the other hand.

It is therefore possible with the assembly according to the invention to provide for a drastic increase in the take-off thrust and/or a substantial reduction in the fuel consumption of aircraft and water craft. Due to the increased take-off acceleration, aircraft will need only short runways; the reduced fuel consumption results not only in less environmental pollution but also permits a reduction in the on-board fuel supply whereby the load carrying capacity and economy of the craft are increased.

Advantageous further developments for impulse coupling as well as applications and embodiments of the invention are described below.

BRIEF DESCRIPTION OF THE APPLICATION DRAWINGS

Below, the invention will be described in detail with reference to the drawing, in which FIG. 1 is a schematic sectional view through an assembly for increasing the propulsive force, to be used in conjunction with a propeller drive, FIGS. 2*a* and 2*b* are vector diagrams for explaining the mode of operation, FIG. 3 is a schematic sectional view through a jet engine including an assembly for increasing the propulsive force, FIG. 4 shows the use of the invention in conjunction with a reaction wheel, FIGS. 5 to 7 illustrates the use of the invention in the low-pressure turbine of a dual-shaft gas turbine, FIG. 5 being an end view, FIG. 6 being an axial sectional view, and FIG. 7 being an annular section about the axis at the level of the line A—A of FIG. 6, and FIG. 8 illustrates the use of the invention in an aircraft.

DETAILED DESCRIPTION OF THE PREFERRED EMBODIMENTS

Figure 1:
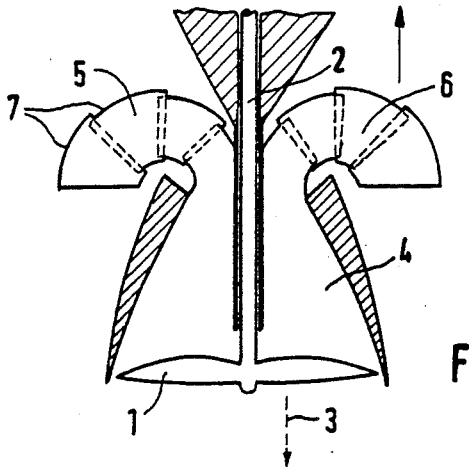

The assembly illustrated in FIG. 1 comprises an adjustable channel for deflecting the fluid inflow forward of a propeller. The propeller 1 is mounted on a drive shaft 2 which is rotated by a prime mover. Assume that the propeller 1 drives a ship; i.e., the direction in which the the driven ship is heading is in the direction of the drive shaft 2 (full-line arrow) while the direction of fluid ejection is in the direction of the dashed-line arrow 3 and therefore in opposition to the direction in which the ship is heading. The propeller 1 is disposed in a channel 4 the front end of which terminates in two arcuate channels 5, 6. The channels 5, 6 are constituted by separate telescope-like pipe members 7. By telescoping the pipe members the arcuate channel portion is shortened and the angle of curvature is reduced. Thereby the change of direction of the inflowing fluid is reduced. When the tubular members 7 are fully extended, the fluid is sucked by the propeller 1 in the direction in which the ship is heading and is deflected through the channels 5, 6 in such a way (by 180°) that it is ejected through the propeller 1 in opposition to the direction in which the ship is heading. When the tubular members 7 are fully telescoped, the fluid is sucked in nearly opposite to the direction in which the ship is heading and is ejected in opposition to the direction in which the ship is heading. There is then a similarity to the conventional ship's propeller.

The improving effects can be explained as follows: Due to the generation of a negative pressure the surrounding fluid, which is initially assumed to be quiescent, is accelerated towards the site of the negative pressure. Thereby a kind of wind towards the site of the negative pressure is produced. With conventional propellers and jet engines this wind blows from forwards, i.e. in opposition to the direction of movement, and thereby produces a decelerating impulse. In the solution according to the invention, this wind blows in the direction of movement in opposition to the arcuate channel and thereby produces a force in the direction of movement and therefore a thrust.

Figure 2A:
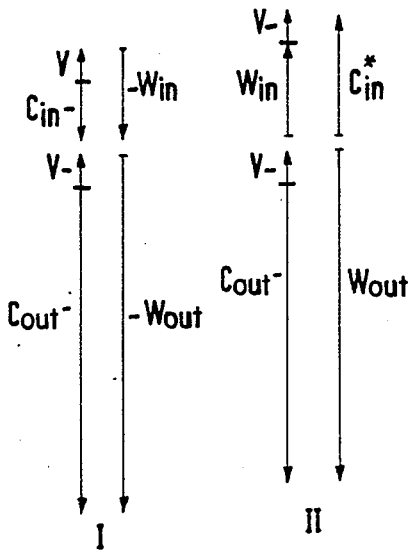

The forces which produce the propulsion can be explained with reference to the "velocity triangles" of FIGS. 2*a* and 2*b*. FIG. 2*a* shows the "velocity triangles" of a conventional propeller and, for comparison, of an assembly according to the invention at low velocities. Diagram I illustrates the conditions for a conventional propeller. The conventional propeller generates a negative pressure and sucks the fluid surrounding the body and having the mass m at the relative velocity $w_{in}$ against the direction of the velocity vector v. The air speed of the craft or propeller is v. The fluid which surrounds the body and which is initially quiescent is therefore brought to the absolute speed $c_{in}$ forwards of the propeller. By vector addition, $c_{in}$ is obtained from v and $w_{in}$. Practically, a pressure jump occurs in the plane of the propeller. Thereby the fluid is accelerated to the relative velocity $w_{out}$. Vector addition of the velocity vector v and the vector for the relative velocity $w_{aus}$ will result in the vector $c_{out}$. Therefore the thrust power on the body is:

$$P=m\cdot v\cdot(w_{out}-w_{in}).$$

With $c_{aus}=w_{out}-v$ and $c_{in}=w_{in}-v$:

$$P=m\cdot v\cdot(w_{aus}-v-w_{in}+v)=m(c_{aus}\cdot v-c_{in}\cdot v).$$

Diagram II of FIG. 2*a* shows the velocity triangles for the assembly according to the invention. Again, the fluid surrounding the body and being at the ambient pressure $p_o$ is sucked in at the relative velocity $w_{in}$, but this occurs in the same direction with the velocity vector v. By the suction process therefore the quiescent fluid surrounding the body is accelerated to the significantly higher absolute velocity $c_{in}^*$, is deflected in the channels 5, 6 of FIG. 1 and moved forwards of the propeller. There, the pressure jump occurs and the fluid flows off the propeller at the relative velocity $w_{out}$. As in the conventional propeller, the absolute velocity $c_{out}$ is obtained by vector addition of $w_{out}$ and v.

Therefore the difference between the assembly according to the invention and the conventional propeller or jet engine results on the suction side.

The thrust forces can be derived as follows:

The pressure of the surrounding quiescent fluid is assumed to be $p_o$. In the conventional propeller, in the propeller plane having the cross-sectional area $A_o$ the flow-through velocity $c_o=(c+v)/2$ (wherein:

c=flow-off velocity relative to the propeller and v=air speed).

Since directly forwards and aft of the propeller the velocity of the entering and the exiting fluid is equal, the force thereof against the propeller is also equal. The propulsion is only created by the pressure difference $(p_2-p_1)$ of the pressure $p_2$ directly aft of the propeller and the pressure $p_1$ directly forwards of the propeller. The thrust $s=(p_2-p_1)A_o$ is the product of this difference with the area $A_o$ swept by the propeller. It can be shown that $(p_2-p_1)=(c^2-v^2)\cdot\rho/2$ (see for instance Becker, E.; Piltz, E.; Übungen zur technischen Strömungslehre; Teubner Stuttgard 1984, pp. 43 et seq.). Because of $m=A_o\cdot c_o\cdot\rho=(c+v)\cdot\rho\cdot A_o/2$ the thrust of the conventional propeller ideally is:

$$S=(p_2-p_1)A_o=(c^2-v^2)\cdot\rho\cdot A_o/2=(c-v)\cdot(c+v)\cdot\rho\cdot A_o/2=\dot{m}(c-v).$$

In the assembly according to the invention, there is a pipe bend with the inflow velocity $w_{in}$ in the inlet section $A_{in}$ and the outflow velocity $w_{aus}$ in the outlet section $A_{aus}$. To simplify matters, let us observe a stationary pipe bend (v=0) which deflects the fluid by 180° (see FIG. 1). Further assuming that $A_{in}=A_o$ and (because of $(c=2c_o-v=2c_o=2\cdot W_{in})$) $A_{out}=A_o/2$, the force acting on the pipe bend can be derived by means of the known formulae (see e.g. Becker, E.; Technische Strömungslehre; Teubner Stuttgart, 5th ed. 1982, pp. 43 et seq.). $p_{in}=p_o-w_{in}^2\cdot\rho/2$ and $p_{out}=p_o$. Therefore there results a propulsive force F acting on the pipe bend:

$$\begin{aligned} F &= ((p_{in}-p_o)+\rho\cdot w_{in}^2)A_{in}+((p_{aus}-p_o)+\rho\cdot w_{out}^2)A_{out} \\ &= (w_{in}^2\cdot\rho/2)A_o+w_{out}^2\cdot\rho\cdot A_o/2=(c^2/4+c^2)\cdot\rho\cdot A_o/2 \\ &= 1{,}25\cdot m\cdot c. \end{aligned}$$

This means that merely by the deflection of the sucked-in fluid according to the invention the propulsive force is increased by 25%. (Note: Because of the modified BERNOULLI formula for gases the increase for air becomes far greater still.)

Figure 3:
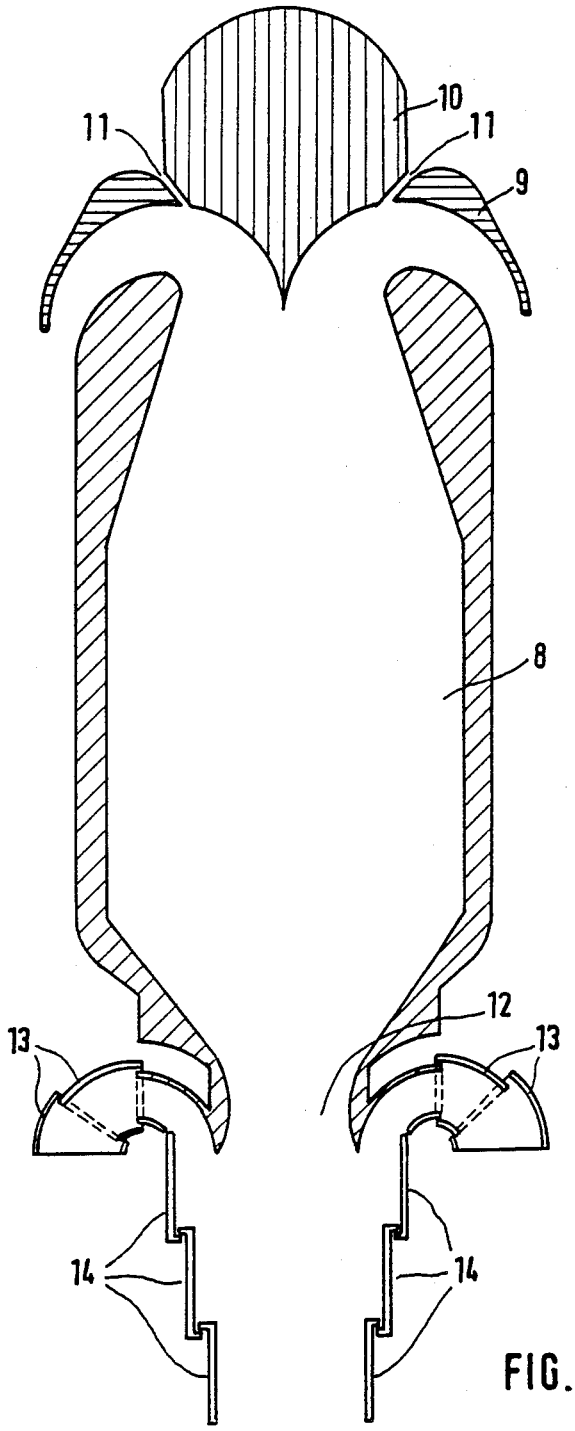

When an injector according to FIG. 3 is further provided behind the outlet opening $A_{out}$, were the fluid flowing off the propeller is the propulsive jet and the surrounding fluid at the pressure $p_o$ is the delivery jet which is deflected in a pipe bend by 180°, the static thrust can be increased much farther. To this end it shall be assumed that in the mixing channel 14 according to FIG. 3 the propulsive jet is decelerated from the flow-off velocity c to the mixing velocity c/5. Under the momentum theorem (simplified derivation) the relationship holds:

$$c\cdot m_T=(\dot{m}_T+m_F\cdot c/5$$

and thence: $m_F=4m_T$.

Assuming that the inflow velocity of the delivery stream $m_F$ into the pipe bend 13 is likewise c/5, the inflow section $A^*_{in}$ (because of continuity equation: $A^*_{in}=(4\cdot\dot{m}_T)/(\rho\cdot c/5)$ and because of:

$$m_{Treib}=A_o\cdot\rho\cdot c/2) \text{ must be:}$$

$$A^*_{in}=10\cdot A_o.$$

The renewed application of the pipe bend formula results in:

$$F = ((p_o - \rho \cdot (c/5)^2/2) - p_o + (c/5)^2 \cdot \rho) \cdot A^*_{in} + (m + m) \cdot c/5$$
$$= 10 \cdot A_o \cdot \rho \cdot c^2/50 + (5\ m) \cdot c/5$$
$$= m \cdot (c + c/2{,}5);$$

Actually, the improvements are even higher, for behind the injector a negative pressure is induced so that the actual delivery stream will be in excess of $4m_T$. The corresponding formulae can be found in Becker, E./-Piltz, E.; Übungen . . . p.52 and p.110. Accordingly, $m_F = 7 \cdot m_T$ so that $A^*_{in} = 17{,}5 \cdot A_o$ and thus $F \cong 2{,}3 \cdot m_T c$.

Due to the deflection of the intake fluid and the use of the injector (simplified derivation) an overall increase of the static thrust of more than 65% results.

The absolute inflow velocity $c_{in}$ cannot become infinitely high. In order to still permit operation at high speeds, the inflow channels are adjustable. This has been described in conjunction with FIG. 1 and also holds for FIG. 3.

Figure 2B:
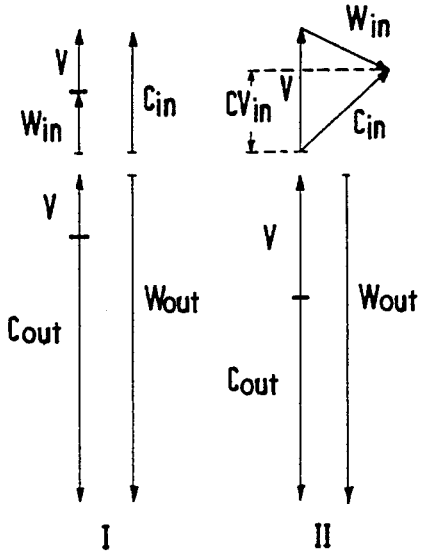

FIG. 2*b* shows the inflow triangles applicable in this respect. Diagram I shows the velocity triangle resulting from the expansion of the sectional area of the inflow channels. Thereby the relative velocity $w_{in}$ and thus the length of the vector $w_{in}$ are reduced.

Diagram II shows a velocity triangle of the assembly according to the invention when the inflow direction is changed. When the direction of the inflow vector $w_{in}$ is changed and the length thereof (=velocity) is predetermined, under the laws of vector addition this will result in $c_{in}$. The propulsion component $cv_{in}$ will then be the projection of $c_{in}$ onto the jet on which v is disposed. This corresponds to the circumferential component $c_u$ in Euler's formula.

In the jet engine 8 illustrated in FIG. 3, an annular cover 9 and a central body 10 are disposed forward of the jet engine and deflect the intake air. Cover 9 and central body 10 are movable. At lower speeds, cover 9 and central body 10 are initially moved forwards together, whereby inflow angle and inflow section are varied. Then, the annular gap 11 is opened by retracting the cover and extending the central body 10, whereby the intake air flows in almost from the front. For additionally increasing the thrust at low speeds, an injector (ejector, jet device) is mounted behind the engine nozzle 12. The injector is comprised of the engine jet 12, which constitutes the propulsive jet of the injector, bent pipe members 13 which constitute the delivery channels of the injector, and telescope-type straight pipe members 14 which constitute the mixing channel of the injector. Force balancing takes place within the injector since the propulsive jet is decelerated and the delivery jet is accelerated. The overall effect is that the force and thus also the propulsion are maintained. Additionally, with the assembly according to the invention a propulsive impulse is created by the deflection of the delivery fluid flowing in with the direction of movement.

At higher speeds the bent pipe members 13 and the straight pipe members 14 are telescoped whereby the injector is "made inoperative".

Figure 4:
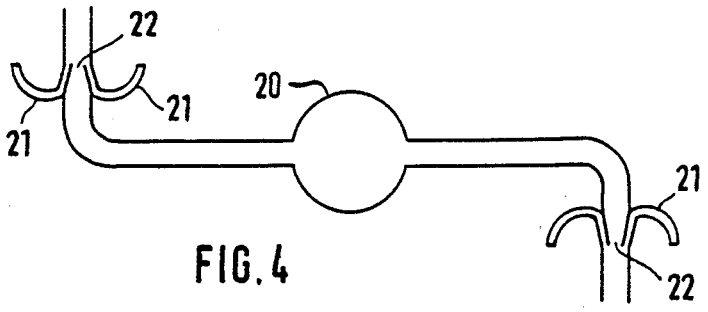

FIG. 4 shows the assembly 21 according to the invention disposed on the outlet nozzle 22 of a steam or gas operated reaction wheel 20. As with the injector of the engine shown in FIG. 3, the incoming delivery stream causes an additional torque.

Figure 5:
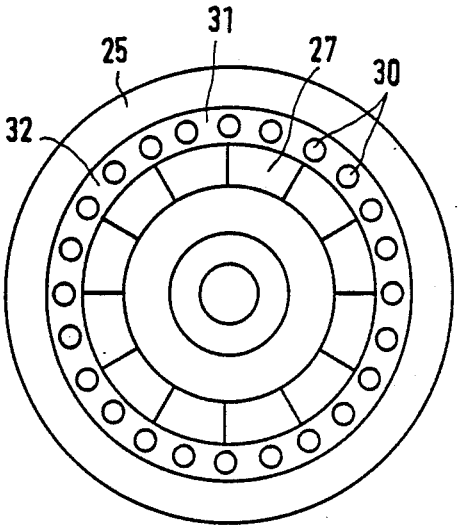
Figure 6:
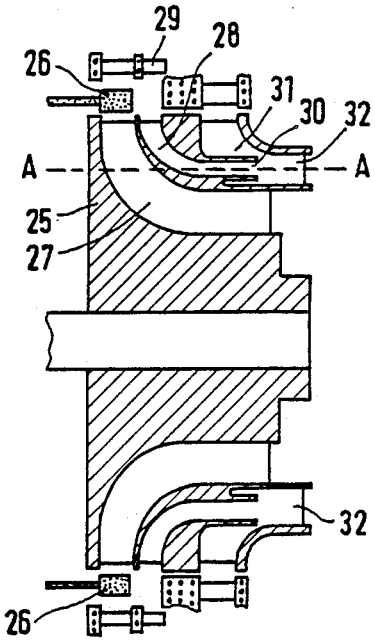
Figure 7:
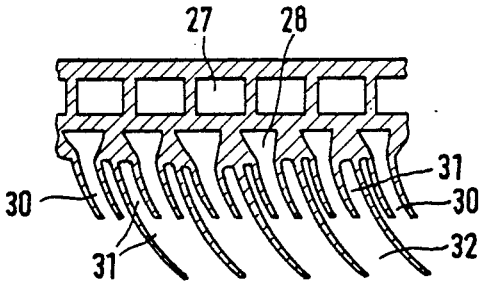

FIGS. 5 to 7 illustrate the assembly according to the invention on the low-pressure turbine of a dual-shaft gas turbine. Dual-shaft gas turbines are used, among other applications, as vehicle drive means, where normally the high-pressure turbine drives the compressor and the low-pressure turbine drives the vehicle drive system. Therefore the low-pressure turbine rotates at different speeds in dependence on the vehicle speed. At low speeds of rotation it exhibits low efficiency.

The turbine wheel 25 illustrated in FIGS. 5 to 7 has the properties of two turbine wheels. At low rotational speeds of the wheel the high-speed channels 27 are closed by an annular slide 26 and the low-speed channels 28 are opened. Thus, the gas from the high-pressure turbine flows through the stator 29 into the low-speed channels 28 of the turbine wheel 25. The low-speed channels 28 open into jet nozzles 30 of injectors. The delivery channels 31 of said injectors draw the surrounding gas in the direction of rotation and due to deflection cause an additional torque acting on the turbine wheel. Through the mixing channnels 32 the gas flows out of the turbine wheel. At higher rotational speeds of the wheel the low-speed channels are closed by the annular slide 26 and the high-speed channels 27 are opened. In that case the gas will flow through the latter.

Figure 8:
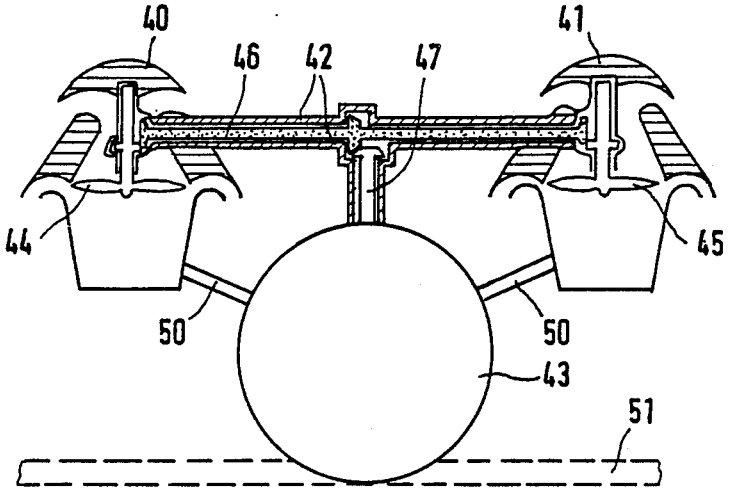

FIG. 8 shows drive means according to the invention on an aircraft. Two assemblies 40, 41 according to the invention are suspended from a carrier member 42 above the flying body 43. They comprise propellers 44, 45 which are driven by a central shaft 46 and by a drive shaft 47 of a motor which is disposed in or above the flying body 43. The assemblies 40, 41 are adapted to be pivoted via control hydraulics 50 about the carrier member 42. In the illustrated position the assemblies 40, 41 cause a pure aerodynamic lift force. When both assemblies are pivoted forwards, propulsion is obtained; when they are pivoted aft, the aircraft is decelerated. By pivoting the one assembly forwards and the other one aft the aircraft will turn about in the air. Analogously, curvilinear flight can be performed by different inclinations of the assemblies. The aircraft can be provided with a lifting surface 51 so that at high speeds the assemblies may cause pure propulsion and the lifting surface provides for aerodynamic lift force. During "helicopter operation" the lifting surfaces may be retracted.

I claim:

1. An assembly for producing a propulsive force to move a body in a first direction through a fluid environment comprising:

channel means fixed to said body and defining a channel, a fluid inlet at one end of said channel, and a fluid outlet at the other end of said channel;

propelling means for driving said body, said propelling means extending through said channel and terminating adjacent said fluid outlet for producing a negative pressure in said channel whereby environmental fluid is sucked in through said inlet, accelerated, and ejected through said outlet in a second direction opposite to said first direction;

channel members forming part of said channel means and located at said inlet forward of said propelling means, said channel members defining fluid inlets at their outer ends and communicating at their inner ends with said channel, having internal walls against which fluid impinges, and means for adjustably mounting said channel members to permit the outer ends thereof to be adjustably moved to and from a first orientation such that said outer ends openly extend openly in a direction toward said outlet, whereby fluid enters said channel members moving in said first direction, is diverted by said internal walls to said channel, and is ejected through said outlet in said second direction, said fluid thereby imparting a directional force on said channel member in said first direction.

2. The assembly of claim 1, wherein said channel members comprises a plurality of telescoping channel sections, the sections when fully extended positioning the outer ends of the channel members in said said first orientation, and fully when telescoped positioning said channel sections in a second orientation generally perpendicular to said first and second directions, the adjustability of said channel sections permitting the outer ends of said channel section to be positioned in any desired location at or between said first and second orientation.

3. An apparatus for producing a propulsive force to move a body in a first direction through a fluid environment, comprising:

a driving unit fixed to said body and having inlet and outlet means communicating with the environment for producing a negative pressure, whereby fluid from the environment is sucked in through said inlet means, accelerated, and ejected through said outlet means into the environment in a second direction opposite to said first direction;

channel means fixed to said body and forming part of said inlet means, said channel means being curved in such a manner that the directional vector of the fluid flow entering the channel means forms an angle different from 180° with said first direction, said channel means having an interior wall shaped so that fluid flowing through the channel means imparts on said interior wall a force acting in said first direction; and means for varying the angle of curvature of said channel means.

* * * * *